US012342852B2

(12) United States Patent
Jang et al.

(10) Patent No.: US 12,342,852 B2
(45) Date of Patent: Jul. 1, 2025

(54) AEROSOL-GENERATING ARTICLE, COOLING ASSEMBLY FOR AEROSOL-GENERATING ARTICLES, AND AIR VOLUME REGULATOR

(71) Applicant: KT&G CORPORATION, Daejeon (KR)

(72) Inventors: Chul Ho Jang, Daejeon (KR); Gyoung Min Go, Daejeon (KR); Hyung Jin Bae, Daejeon (KR); Jangwon Seo, Daejeon (KR); Minseok Jeong, Seoul (KR); Jong Seong Jeong, Sejong (KR); Jin Chul Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 643 days.

(21) Appl. No.: 17/602,145

(22) PCT Filed: Jul. 19, 2021

(86) PCT No.: PCT/KR2021/009236
§ 371 (c)(1),
(2) Date: Oct. 7, 2021

(87) PCT Pub. No.: WO2022/019587
PCT Pub. Date: Jan. 27, 2022

(65) Prior Publication Data

US 2022/0400741 A1 Dec. 22, 2022

(30) Foreign Application Priority Data

Jul. 23, 2020 (KR) ..... 10-2020-0091750

(51) Int. Cl.
*A24D 1/02* (2006.01)
*A24D 3/04* (2006.01)

(52) U.S. Cl.
CPC ..... *A24D 1/027* (2013.01); *A24D 3/041* (2013.01); *A24D 3/043* (2013.01)

(58) Field of Classification Search
None
See application file for complete search history.

(56) References Cited

U.S. PATENT DOCUMENTS 3,503,406 A 3/1970 Riegel et al.
4,898,190 A 2/1990 Deal
(Continued)

FOREIGN PATENT DOCUMENTS

CN 1709169 A * 12/2005
CN 102697185 A 10/2012
(Continued)

OTHER PUBLICATIONS

Espacenet English Translation for KR20160080482 (Year: 2024).*
(Continued)

*Primary Examiner* — Manley L Cummins, IV
(74) *Attorney, Agent, or Firm* — Sughrue Mion, PLLC

(57) ABSTRACT

A cooling assembly for the aerosol-generating article according to an embodiment may include a cooling rod for cooling an aerosol generated by the aerosol-generating article; a perforation formed in the cooling rod and through which air passes; and an air volume regulator disposed on the outside of the cooling rod to cover the perforation, and regulating an amount of air passing through the perforation as the air volume regulator moves from one position to another.

7 Claims, 19 Drawing Sheets

(56) References Cited

U.S. PATENT DOCUMENTS

| | | | | |
|---|---|---|---|---|
| 9,578,899 | B2 | 2/2017 | Liu | |
| 9,949,504 | B2 | 4/2018 | Emmett et al. | |
| 10,426,192 | B2 | 10/2019 | Blick et al. | |
| 2013/0306085 | A1 | 11/2013 | Sanchez et al. | |
| 2014/0318562 | A1* | 10/2014 | Emmett | A24D 3/043 131/336 |
| 2014/0352707 | A1 | 12/2014 | Liu | |
| 2014/0353856 | A1 | 12/2014 | Dubief | |
| 2015/0351451 | A1* | 12/2015 | Kaljura | A24D 3/041 131/336 |
| 2016/0029692 | A1* | 2/2016 | Duggan | A24D 1/025 131/365 |
| 2016/0157522 | A1 | 6/2016 | Zhu | |
| 2016/0227838 | A1* | 8/2016 | Johnson | A24F 40/46 |
| 2017/0360084 | A1 | 12/2017 | Kaljura et al. | |
| 2018/0064172 | A1 | 3/2018 | Qiu | |
| 2018/0256834 | A1 | 9/2018 | Hepworth et al. | |
| 2021/0000180 | A1 | 1/2021 | Hwang et al. | |

FOREIGN PATENT DOCUMENTS

| | | | | |
|---|---|---|---|---|
| CN | 105142440 | A | | 12/2015 | |
| EP | 0107507 | A1 | | 5/1984 | |
| EP | 0 845 220 | B1 | | 9/2003 | |
| JP | 54-80889 | U | | 6/1979 | |
| JP | 56-97998 | U | | 8/1981 | |
| JP | 62-30846 | U | | 2/1987 | |
| JP | 3-41600 | U | | 4/1991 | |
| JP | 3042782 | U | | 10/1997 | |
| JP | 2016-34281 | A | | 3/2016 | |
| JP | 2016-519943 | A | | 7/2016 | |
| JP | 2019-187423 | A | | 10/2019 | |
| KR | 10-1607994 | B1 | | 3/2016 | |
| KR | 10-2016-0069997 | A | | 6/2016 | |
| KR | 10-2016-0080482 | A | | 7/2016 | |
| KR | 10-1710120 | B1 | | 2/2017 | |
| KR | 10-2076125 | B1 | | 2/2020 | |
| KR | 10-2020-0030896 | A | | 3/2020 | |
| KR | 10-2020-0061290 | A | | 6/2020 | |
| TW | 201637578 | A | * | 11/2016 | A24D 3/027 |
| WO | 97/48293 | A1 | | 12/1997 | |
| WO | 2014/053829 | A1 | | 4/2014 | |
| WO | 2019/110768 | A1 | | 6/2019 | |
| WO | 2019/186147 | A1 | | 10/2019 | |
| WO | 2020/105944 | A1 | | 5/2020 | |

OTHER PUBLICATIONS

CN_1709169 English Translation (Year: 2005).*

TW_201637578 English Translation (Year: 2016).*

Office Action issued Jul. 6, 2022 in Korean Application No. 10-2020-0091750.

Extended European Search Report issued Jun. 20, 2022 in European Application No. 21766369.9.

Japanese Office Action dated Dec. 5, 2023 in App. No. 2021-556663.

Notice of Reasons for Refusal issued Nov. 22, 2022 in Japanese Application No. 2021-556663.

Office Action dated Apr. 28, 2023, issued in Chinese Application No. 202180005250.2.

Office Action dated Jun. 6, 2023, issued in Japanese Application No. 2021-556663.

International Search Report dated Oct. 25, 2021 from the International Searching Authority in International Application No. PCT/KR2021/009236.

* cited by examiner

AEROSOL-GENERATING ARTICLE, COOLING ASSEMBLY FOR AEROSOL-GENERATING ARTICLES, AND AIR VOLUME REGULATOR

TECHNICAL FIELD

Embodiments relate to aerosol-generating articles, cooling assemblies for aerosol-generating articles, and air volume regulators, and more particularly to aerosol-generating articles capable of regulating the amount of air passing through perforations, cooling assemblies for aerosol-generating articles, and air volume regulators.

BACKGROUND ART

Recently, there is an increasing demand for technology to replace a method of supplying an aerosol by burning a general cigarette. For example, research on a method of generating an aerosol from an aerosol-generating material in a liquid or solid state, or supplying an aerosol having a flavor is in progress by generating vapor from a liquid-state aerosol-generating material and then passing the generated vapor through a solid-state fragrance medium.

An aerosol-generating article includes perforations for passage of outside air. The perforations serve to cool the aerosol-generating article as the outside air passes through.

Here, because there is no separate device for regulating the amount of air passing through the perforations in the prior art, it is difficult for a user to control the amount of cooling of the aerosol-generating article.

DESCRIPTION OF EMBODIMENTS

Technical Problem

Embodiments provide an aerosol-generating article capable of regulating the amount of cooling of the aerosol-generating article, a cooling assembly for the aerosol-generating article, and an air volume regulator.

Solution to Problem

Embodiments may implement an aerosol-generating article, a cooling assembly for the aerosol-generating article, and an air volume regulator.

An aerosol-generating article according to an embodiment may include a cooling assembly for an aerosol-generating article; a medium rod disposed on one side of the cooling assembly for the aerosol-generating article; and a filter rod disposed on the other side of the cooling assembly for the aerosol-generating article.

A cooling assembly for the aerosol-generating article according to an embodiment may include a cooling rod for cooling an aerosol generated by the aerosol-generating article; a perforation formed in the cooling rod and through which air passes; and an air volume regulator disposed on the outside of the cooling rod to cover the perforation, and regulating an amount of air passing through the perforation as the air volume regulator moves from one position to another.

An air volume regulator according to an embodiment may include a covering member for covering at least some of perforations formed in the cooling rod for cooling the aerosol generated by the aerosol-generating article; and a through hole formed in the covering member and communicating with the perforations.

Advantageous Effects of Disclosure

The aerosol-generating article, the cooling assembly for the aerosol-generating article, and the air volume regulator according to the embodiments as described above, because the amount of air passing through perforations may be controlled through a relatively easy operation, may be implemented to adjust a cooling amount depending on the user's preference and improve the ease of an operation of adjusting a cooling amount.

BEST MODE

Figure 1:
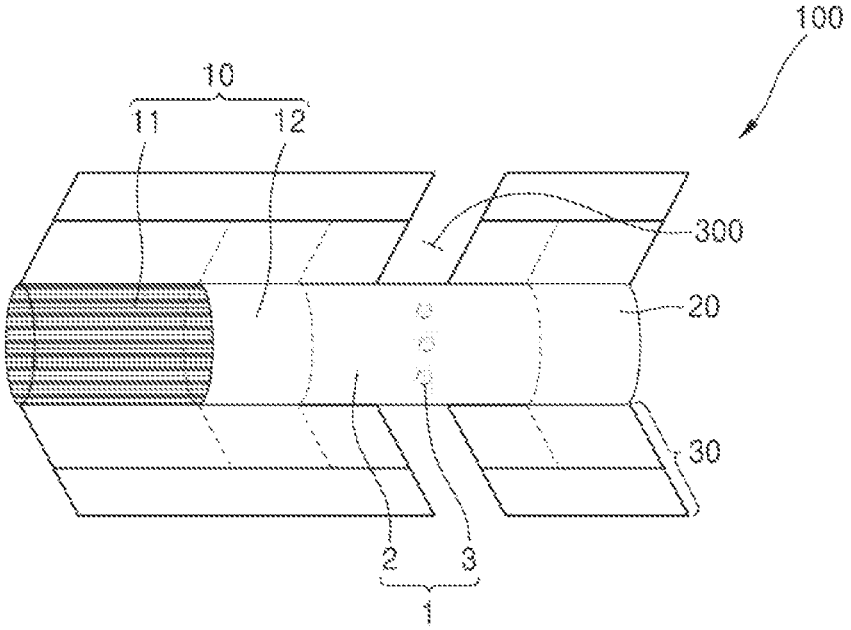
FIG. 1 is a schematic perspective view illustrating an example of an aerosol-generating article.

In an embodiment, a plurality of the perforations may be formed along the radial direction of the cooling rod, and the air volume regulator may be rotated along the radial direction of the cooling rod to regulate the amount of air passing through the perforation.

In an embodiment, a plurality of the perforations may be formed along the extending direction of the cooling rod, the air volume regulator may be moved along the extending direction of the cooling rod to regulate the amount of air passing through the perforation.

In an embodiment, the air volume regulator may be disposed to surround the cooling rod.

In an embodiment, the air volume regulator may include a covering member for covering at least some of the perforations, and a through hole formed in the covering member and communicating with the perforation.

In an embodiment, the through hole may have a shape corresponding to the perforation.

In an embodiment, one or more of the perforations may form a group, and the group may be formed in plurality in the cooling rod.

In an embodiment, the air volume regulator may include a material whose size is capable of being changed.

In an embodiment, the air volume regulator may be spaced apart from the cooling rod as the size of the air volume regulator increases and contacts the outer surface of the cooling rod as the size of the air volume regulator decreases.

In an embodiment, the cooling assembly may further include a support device protruding to the outside of the cooling rod and for supporting the air volume regulator.

In an embodiment, the support device may include a first support member disposed on one side of the cooling rod to support one side of the air volume regulator, and a second support member disposed on the other side of the cooling rod to support the other side of the air volume regulator.

In an embodiment, the air volume regulator may be disposed between the first support member and the second support member.

In an embodiment, a separation distance between the second support member and the first support member may be the same as a length of the air volume regulator with respect to an extending direction of the cooling rod.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

The present invention relates to an aerosol-generating article, a cooling assembly for the aerosol-generating article, air volume regulator, and an aerosol-generating device. Because the cooling assembly for the aerosol-generating article and the air volume regulator according to an embodiment are included in the aerosol-generating article, the cooling assembly for the aerosol-generating article and the air volume regulator will be described together while describing the aerosol-generating article.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Figure 2:
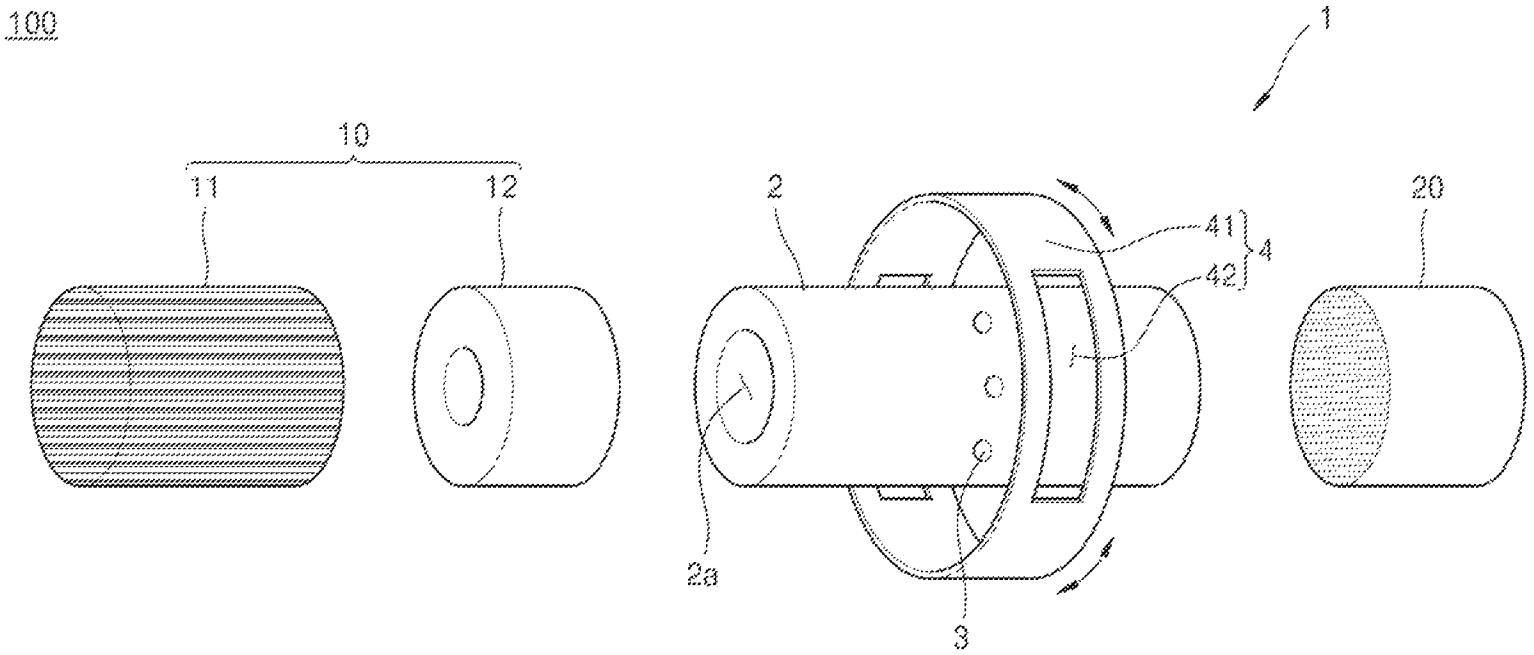
FIG. 2 is a schematic exploded perspective view of an aerosol-generating article including a cooling assembly for an aerosol-generating article according to an embodiment.
Figure 3:
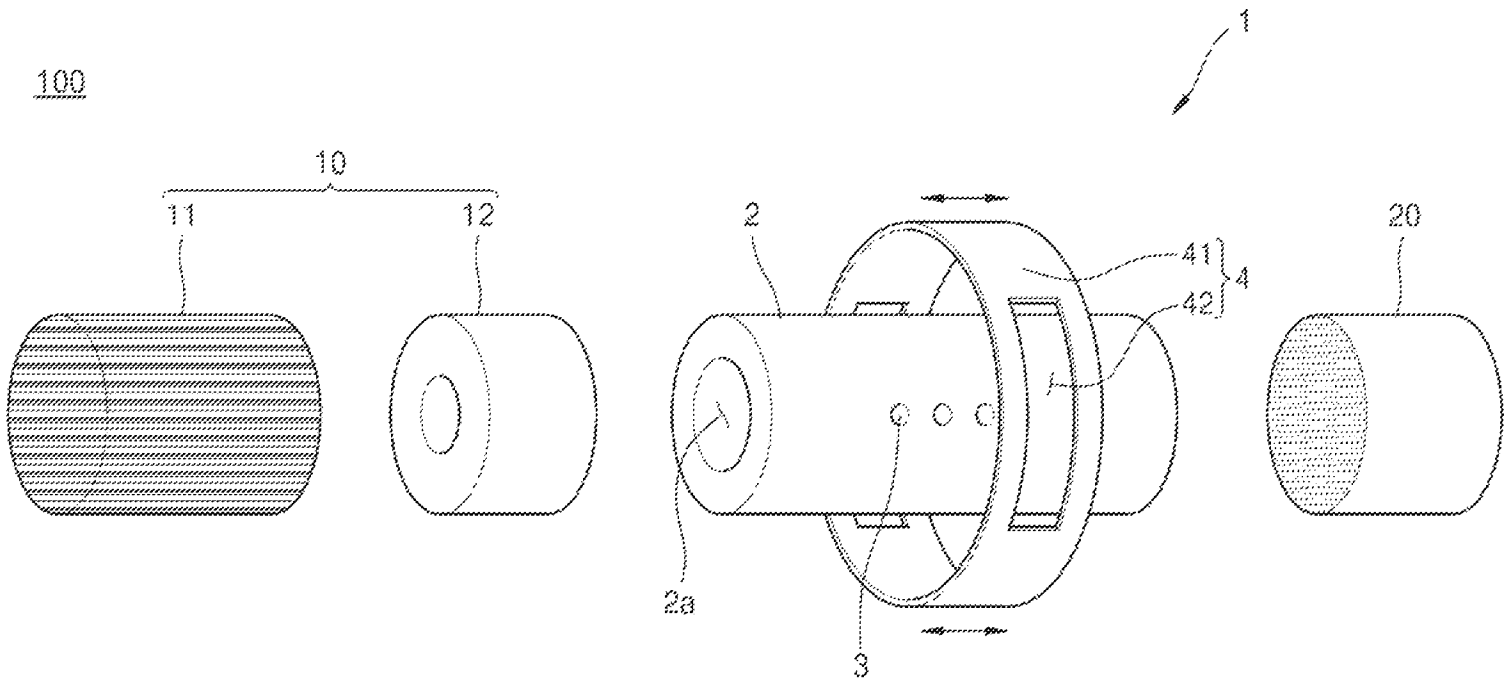
FIG. 3 is a schematic exploded perspective view of an aerosol-generating article including a cooling assembly for the aerosol-generating article according to another embodiment.

FIG. 1 is a schematic perspective view illustrating an example of an aerosol-generating article, FIG. 2 is a schematic exploded perspective view of the aerosol-generating article including a cooling assembly for an aerosol-generating article according to an embodiment, and FIG. 3 is a schematic exploded perspective view of the aerosol-generating article including the cooling assembly for the aerosol-generating article according to another embodiment.

Referring to FIGS. 1 to 3, an aerosol-generating article 100 according to one embodiment may include a medium rod 10, a filter rod 20, and a cooling assembly 1 for the aerosol-generating article.

The medium rod 10 is disposed on one side of the cooling assembly 1 for the aerosol-generating article. The medium rod 10 may include an aerosol generator (not shown), a medium portion 11, and a tube filter 12.

The aerosol-generating article according to an embodiment may include nicotine in the aerosol-generator. Meanwhile, the material, order, and length of the aerosol generator and the medium unit 11 are not limited to specific examples.

The aerosol-generator may not include nicotine. In addition, the aerosol generator may include an aerosol-generating material excluding nicotine. For example, the aerosol generator may include at least one of glycerin, propylene glycol, ethylene glycol, dipropylene glycol, diethylene glycol, triethylene glycol, tetraethylene glycol and oleyl alcohol, but this is exemplary and is not limited to a specific example. For example, the aerosol generator may include a material in which glycerin and propylene glycol are mixed in a ratio of about 8:2. However, the aerosol generator is not limited to the above-described mixing ratio. In addition, the aerosol generator may include other additive substances such as flavoring agents, wetting agents and/or organic acids. In addition, the aerosol generator may include a flavoring liquid such as menthol or a moisturizing agent.

The aerosol generator may include a crimped sheet, and the aerosol-generating material may be included in the aerosol generator in a state impregnated in the crimped sheet. In addition, other additive substances such as flavoring agents, wetting agents and/or organic acids, and the flavoring liquid may be included in the aerosol generator in a state of being absorbed into the crimped sheet.

The crimped sheet may be a sheet made of a polymer material. For example, the polymer material may include at least one of paper, cellulose acetate, lyocell, and polylactic acid. For example, the crimped sheet may be a paper sheet that does not generate off-flavor due to heat even when heated to a high temperature. However, the crimped sheet is not limited thereto.

The aerosol generator may be formed to have a length in the range of 4 mm to 12 mm, but this is exemplary and is not limited to a specific length. Preferably, the aerosol generator may be formed to have a length of about 10 mm.

The medium portion 11 may include nicotine. In addition, the medium portion 11 may include an aerosol-generating material such as glycerin, propylene glycol, and the like. In addition, the medium portion 11 may include other additive substances such as flavoring agents, wetting agents and/or organic acids. In addition, the flavoring liquid such as menthol or a moisturizing agent may be added to the medium portion 11 by being sprayed into the medium portion 11.

As an example, the aerosol-generating material may include tobacco cut filler or reconstituted tobacco material. In detail, the aerosol-generating material may include nicotine, and the nicotine may be obtained by shaping or reconstituting tobacco leaves. As another example, the aerosol-generating material may include one of free base nicotine, a nicotine salt, or a combination thereof. In detail, the nicotine may be naturally occurring nicotine or synthetic nicotine.

For example, the medium portion 11 may include a combination of different types of tobacco leaves. In addition, the combination may be processed through various processing processes, but this is illustrative and not limited to a particular formulation.

Nicotine salts may be formed by adding suitable acids, including organic or inorganic acids, to nicotine. An acid for the formation of the nicotine salt may be appropriately selected in consideration of the blood nicotine absorption rate, the heating temperature of the heater, flavor or savor, solubility, and the like. For example, the acid for the formation of the nicotine salt may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but this is exemplary and is not limited to a specific example.

The medium portion 11 may be manufactured in various ways. For example, the medium portion 11 may be manufactured as a sheet or as a strand. Also, the medium portion 11 may be made of cut filler from which the tobacco sheet is cut into small pieces.

The length of the medium portion 11 may be an appropriate length within the range of 6 mm to 18 mm, but is not limited thereto. Preferably, the medium portion 11 may be formed to have a length of about 12 mm.

The tube filter 12 is disposed between the medium portion 11 and the cooling assembly 1 for the aerosol-generating article. The tube filter 12 may serve to support the medium portion 11 and the cooling assembly 1 for the aerosol-generating article. The tube filter 12 may be a tube-shaped structure including a hollow therein.

Referring to FIGS. 1 to 3, the filter rod 20 is disposed on the other side of the cooling assembly 1 for the aerosol-generating article. Aerosol generated from the medium rod 10 may be inhaled by the user through the filter rod 20. The filter rod 20 may be manufactured by adding a plasticizer (e.g., triacetin) to cellulose acetate tow. The filter rod 20 may be formed to have a length within the range of 4 mm to 30 mm, but this is exemplary and is not limited to a specific length. Preferably, the filter rod 20 may be formed to have a length of about 14 mm.

The filter rod 20 may be manufactured to generate flavor. As an example, the flavoring liquid may be sprayed onto the filter rod 20, and a separate fiber coated with the flavoring liquid may be inserted into the filter rod 20.

In addition, the filter rod 20 may include at least one capsule. As an example, the capsule includes scented liquid, the flavor may be generated by the scented liquid leaked as the capsule is crushed. As another example, the capsule may include an aerosol-generating material, and as the capsule is crushed, an aerosol may be generated by the leaked material. The capsule may have a structure in which the scented liquid or the aerosol-generating material is wrapped with a film. The capsule may have a spherical or cylindrical shape, but is not limited thereto.

Referring to FIG. 1, the periphery of the aerosol-generating article 100 may be surrounded by a packaging material 30. In addition, a thermally conductive wrapper (not shown) for conducting heat may be disposed in some or all of the packaging material 30, the aerosol generator, and the medium rod 10. In this case, an aerosol-generating device 200 may generate an aerosol by uniformly heating the outside of the thermally conductive wrapper. The thermally conductive wrapper may be disposed on the outside of the aerosol generator and the medium rod 10.

The packaging material 30 may include a securing groove 300 (shown in FIG. 1). When the packaging material 30 surrounds the periphery of the aerosol-generating article 100, the securing groove 300 may be formed in a portion where the perforation 3 is formed.

Figure 4:
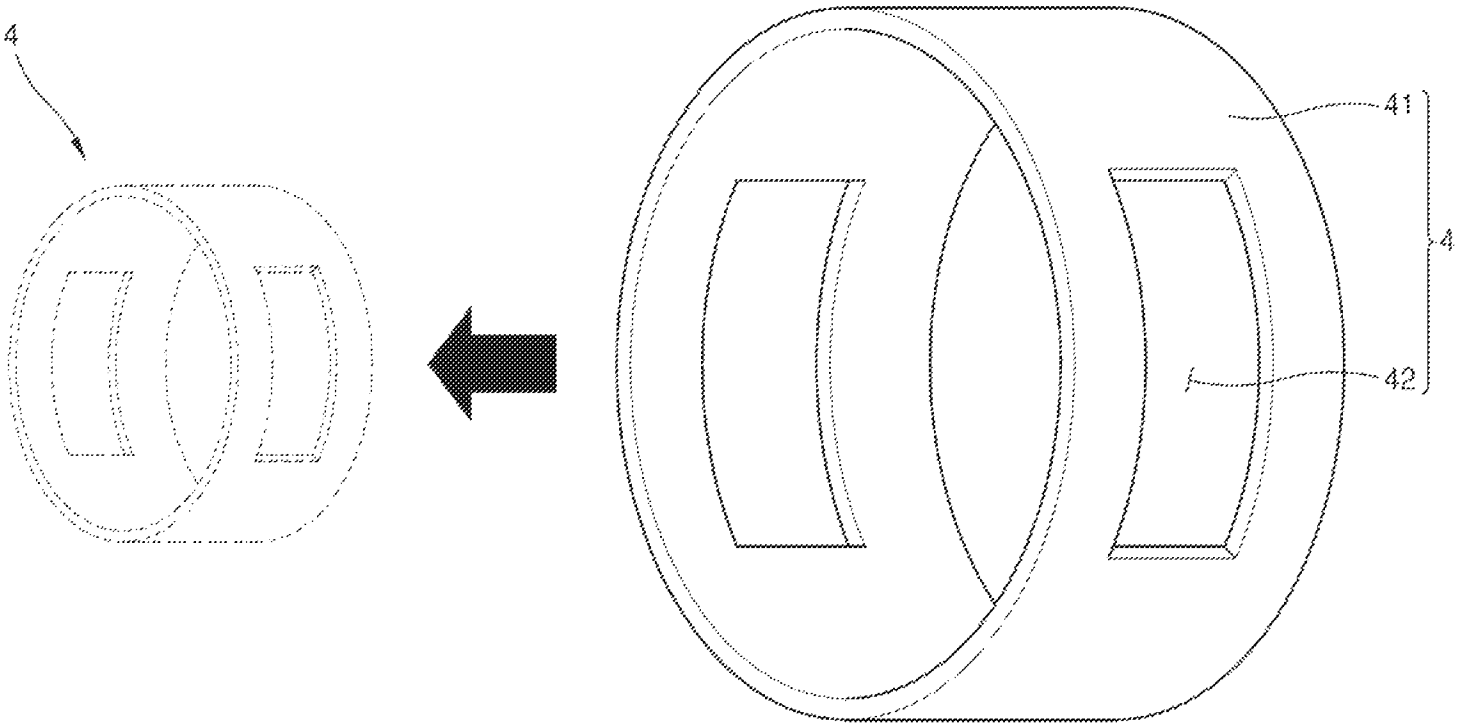
FIG. 4 is a view for explaining that the size of an air volume regulator according to an embodiment is changed.
Figure 5:
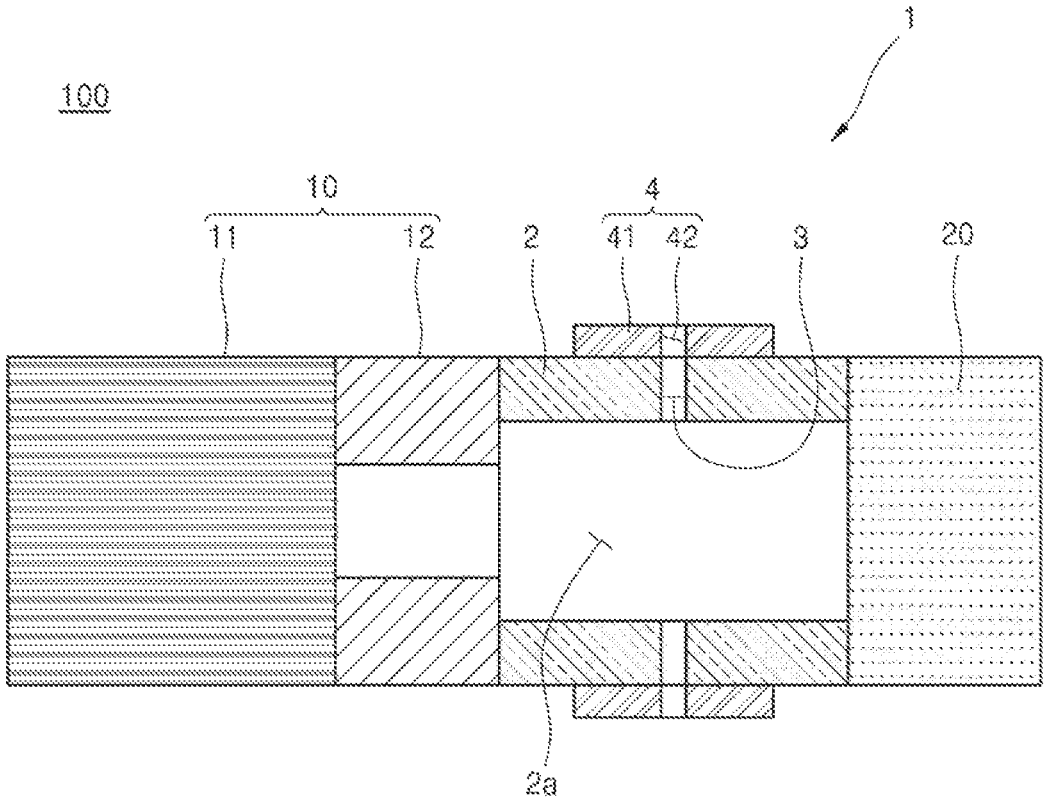
FIG. 5 is a schematic front cross-sectional view of an aerosol-generating article for explaining that a through hole of an air volume regulator according to an embodiment is in communication with a perforation.
Figure 6:
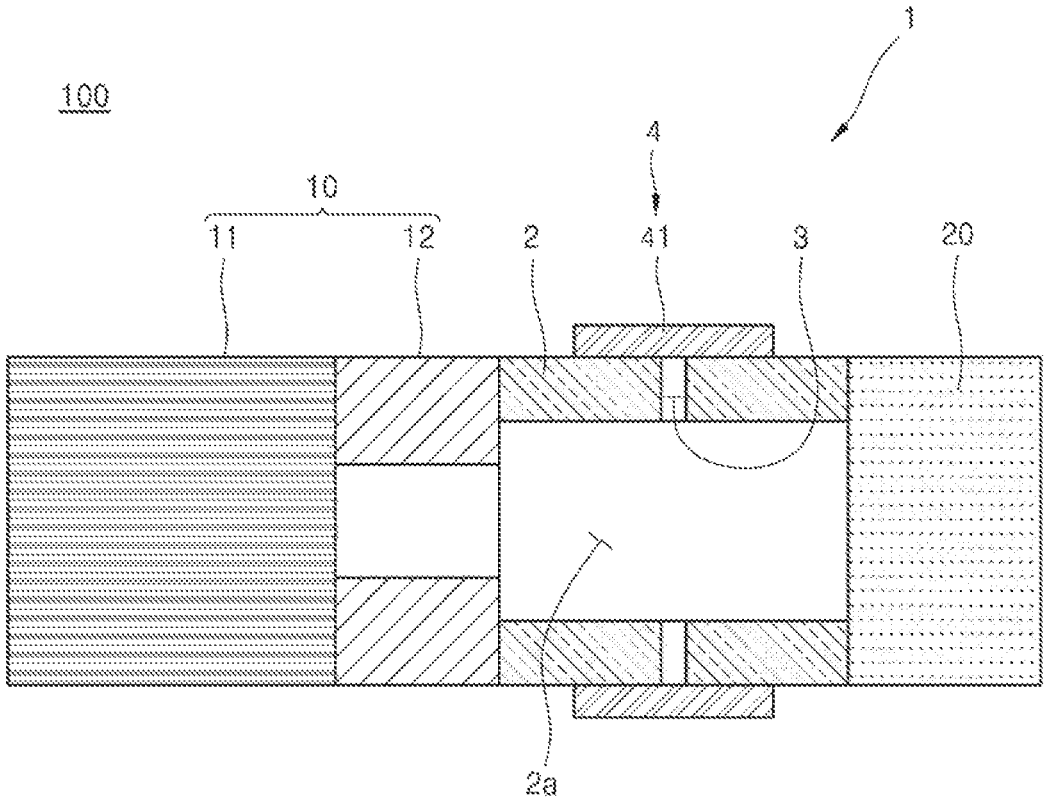
FIG. 6 is a schematic front cross-sectional view of an aerosol-generating article for explaining that a covering member of the air volume regulator according to an embodiment covers a perforation.

FIG. 4 is a view for explaining that the size of an air volume regulator according to an embodiment is changed, FIG. 5 is a schematic front cross-sectional view of an aerosol-generating article for explaining that a through hole of an air volume regulator according to an embodiment is in communication with a perforation, and FIG. 6 is a schematic front cross-sectional view of an aerosol-generating article for explaining that a covering member of the air volume regulator according to an embodiment covers a perforation.

Referring to FIGS. 2 to 6, a cooling assembly 1 for an aerosol-generating article according to an embodiment includes a cooling rod 2 for cooling the aerosol generated from the aerosol-generating article 100, perforations 3 which are formed in the cooling rod 2 and through which air passes, and an air volume regulator 4 that is disposed on the outside of the cooling rod 2 to cover the perforation 3 and adjusts the amount of air passing through the perforation 3 as the air volume regulator 4 moves from one position to another. Accordingly, the cooling assembly 1 for the aerosol-generating article according to an embodiment may achieve the following effects.

First, because the cooling assembly 1 for the aerosol-generating article according to an embodiment may regulate the amount of air passing through the perforations 3 through a relatively easy operation of moving the air volume regulator 4 by a user, the cooling assembly 1 may be implemented to adjust the amount of cooling based on the user's preference, and at the same time may improve the easiness of the operation of adjusting the amount of cooling.

Second, the cooling assembly 1 for the aerosol-generating article according to an embodiment may be implemented so that the amount of air passing through the perforations 3 is controlled, so that the user may control the amount of tar, the amount of nicotine, and the amount of air. Accordingly, the cooling assembly 1 for the aerosol-generating article according to an embodiment may improve the variety of tobacco flavor because the user may inhale various amounts of tar, nicotine and air based on the user's preference.

On the other hand, the air volume regulator 4 may include a material whose size may be changed. In this case, the air volume regulator 4 may be spaced apart from the cooling rod 2 as the size of the air volume regulator 4 increases and contact the outer surface of the cooling rod 2 as the size of the air volume regulator 4 decreases. Accordingly, the cooling assembly 1 for the aerosol-generating article according to an embodiment may be implemented so that the air volume regulator 4 may be used repeatedly rather than once. Therefore, the cooling assembly 1 for the aerosol-generating article according to an embodiment may increase the service life of the air volume regulator 4. The air volume regulator 4 may be formed of a material whose size may be changed by heat or light. The air volume regulator 4 may be formed of a material such as paper, plastic, or vinyl. The dotted line shown in FIG. 4 shows the air amount regulator 4 of which the size is changed.

Hereinafter, the cooling rod 2, the perforation 3, and the air volume regulator 4 will be described in detail with reference to the accompanying drawings.

Referring to FIGS. 1 to 6, the cooling rod 2 is for cooling the aerosol generated by the aerosol-generating article 100. The cooling rod 2 may be disposed between the tube filter 12 and the filter rod 20.

The cooling rod 2 may be made of cellulose acetate. For example, the cooling rod 2 may be manufactured by adding a plasticizer (e.g., triacetin) to cellulose acetate tow. For example, a mono denier of the cooling rod 2 may be 5.0 and a total denier may be 28,000, but this is exemplary and is not limited to a specific mono denier.

The cooling rod 2 is made of paper, and may be a tube-shaped structure including a hollow 2*a* therein. The diameter of the hollow 2*a* included in the cooling rod 2 may be an appropriate diameter within the range of 4 mm to 8 mm, but this is exemplary and is not limited to a specific diameter. Preferably, the hollow 2*a* of the cooling rod 2 may be formed to have a diameter within the range of 7.0 mm to 7.5 mm. The cooling rod 2 may be formed to have a length within the range of 4 mm to 30 mm, but this is exemplary and is not limited to a specific length. Preferably, the cooling rod 2 may be formed to have a length of about 12 mm.

The cooling rod 2 may be manufactured by lamination composed of several papers. For example, the cooling rod 2 may be manufactured by lamination consisting of an outer paper, an intermediate paper, and an inner paper, but is not limited thereto. Meanwhile, the inner surface of the inner paper constituting the paper may be coated with a predetermined material (e.g., polylactic acid).

On the other hand, when the cooling rod 2 is made of paper, the total thickness of the cooling rod 2 may be included in the range of 330 μm to 340 μm. Preferably, the total thickness of the cooling rod 2 may be about 333 μm, but this is exemplary and is not limited to a specific thickness.

In addition, when the cooling rod 2 is made of paper, the total basis weight of the cooling rod 2 may be included in the range of 230 $g/m^2$ to 250 $g/m^2$. Preferably, the total basis weight of the cooling rod 2 may be about 240 $g/m^2$, but is not limited thereto.

Figure 7:
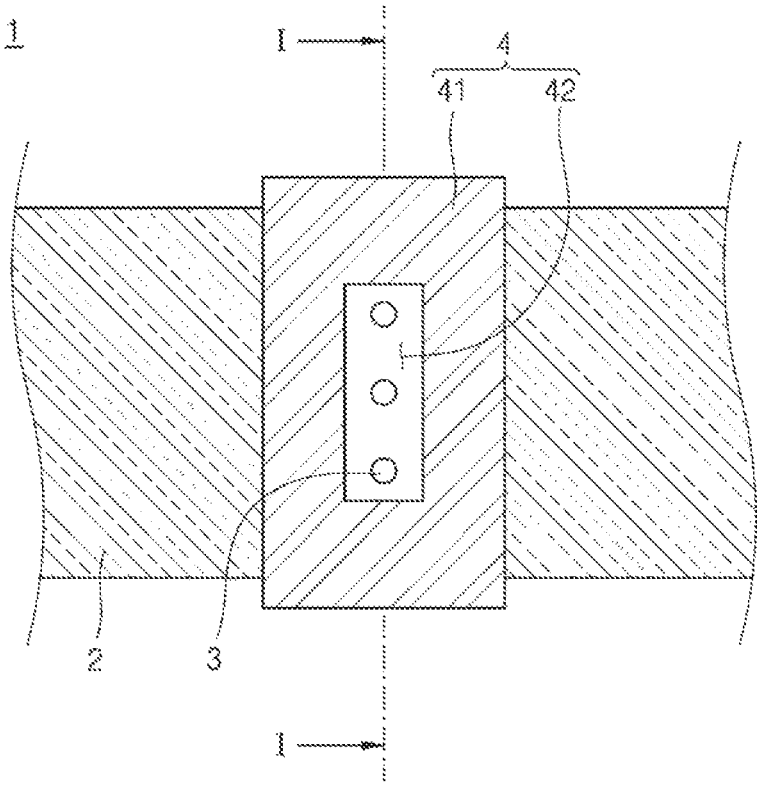
FIG. 7 is a schematic front view of a cooling assembly for an aerosol-generating article for explaining that a through hole of an air volume regulator according to an embodiment communicates with perforations.
Figure 8:
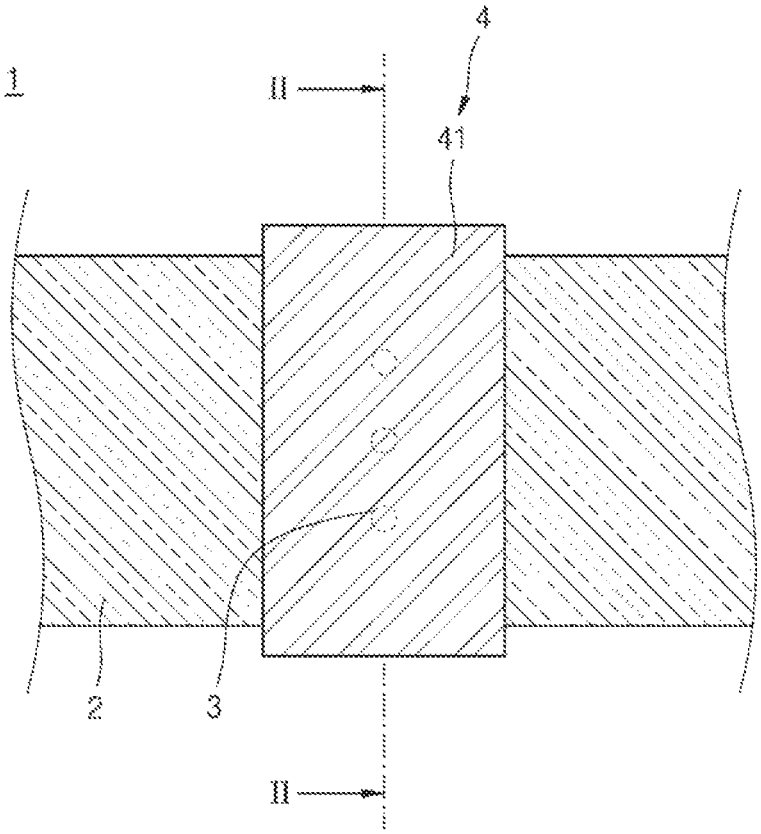
FIG. 8 is a schematic front view of a cooling assembly for an aerosol-generating article for explaining that a covering member of the air volume regulator according to an embodiment covers the perforations.

FIG. 7 is a schematic front view of a cooling assembly for an aerosol-generating article for explaining that a through hole of an air volume regulator according to an embodiment communicates with perforations, and FIG. 8 is a schematic front view of a cooling assembly for an aerosol-generating article for explaining that a covering member of the air volume regulator according to an embodiment covers the perforations. The hatching shown in FIGS. 7 and 8 is not shown in cross section, but is shown to distinguish the configuration.

Referring to FIGS. 1 to 8, the perforation 3 is for air to pass through. Air may be introduced into the inside of the cooling rod 2 through the perforation 3 or may flow out of the cooling rod 2. The perforations 3 may be formed in the cooling rod 2. Accordingly, the cooling assembly 1 for an aerosol-generating article according to an embodiment may use external air to cool the aerosol, thereby improving the overall cooling performance. In addition, because the aerosol-generating article 100 according to an embodiment may use the air introduced through the perforation 3 in the process of inhaling the aerosol by the user, it is possible to improve the atomization amount by increasing an overall intake amount.

The perforation 3 may be formed through the cooling rod 2 in a radial direction. The radial direction may be a direction perpendicular to the direction in which the aerosol-generating article 100 extends. The perforation 3 may be implemented as a hole formed in a cylindrical shape as a whole, but this is exemplary and may be formed in another shape as long as external air may be introduced.

The perforations 3 may be formed in each of the cooling rod 2 and the packaging material 30 (shown in FIG. 1). In this case, the perforations 3 formed in the cooling rod 2 and the perforations 3 formed in the packaging material 30 may be at positions corresponding to each other.

Although not shown, the distance between the perforation 3 and one end of the cooling rod 2 may be formed shorter than the distance between the perforation 3 and the other end of the cooling rod 2. Accordingly, the cooling effect through the perforation 3 may be started at a point relatively far from the filter rod 20. Accordingly, in the aerosol-generating article 100, the time for which the outside air stays inside the cooling rod 2 may be increased, and thus the cooling performance by the outside air may be further improved. The medium rod 10 may be disposed at one end of the cooling rod 2. The filter rod 20 may be disposed at the other end of the cooling rod 2.

The perforation 3 and the cooling rod 2 are not limited to the above-described examples, and in a case where the aerosol may perform the function of cooling, it may be applicable without limitation.

A plurality of perforations 3 may be formed along the radial direction of the cooling rod 2 as shown in FIG. 2. In this case, the air volume regulator 4 may regulate the amount of air passing through the perforation 3 by rotating along the radial direction of the cooling rod 2.

The plurality of perforations 3 may be formed along the extending direction of the cooling rod 2 as shown in FIG. 3. In this case, the air volume regulator 4 may regulate the amount of air passing through the perforation 3 by moving along the extending direction of the cooling rod 2. Hereinafter, an embodiment in which the air volume regulator 4 rotates along the radial direction of the cooling rod 2 to regulate the amount of air passing through the perforation 3 will be described, but from this, it will be apparent to those of ordinary skill in the art to which the present invention pertains to derive an embodiment in which the air volume regulator 4 moves along the extending direction of the cooling rod 2 to regulate the amount of air passing through the perforation 3.

Referring to FIGS. 2 to 8, the air volume regulator 4 is for regulating the amount of air passing through the perforation as it moves from one position to another. The one position and the another position may be a predetermined position of the air volume regulator 4 disposed on the outside of the cooling rod 2. The one position and the another position may be positions spaced apart from each other. The air volume regulator 4 may be disposed on the outside of the cooling rod 2 to cover at least some of the perforations 3.

The air volume regulator 4 may be disposed to surround the cooling rod 2. At least a portion of the cooling rod 2 may be inserted into the air volume regulator 4. The air volume regulator 4 may be formed in a circular ring shape as a whole, but this is exemplary and may be formed in a different form as long as the air volume regulator 4 may be disposed on the outside of the cooling rod 2 to cover at least some of the perforations 3.

Figure 9:
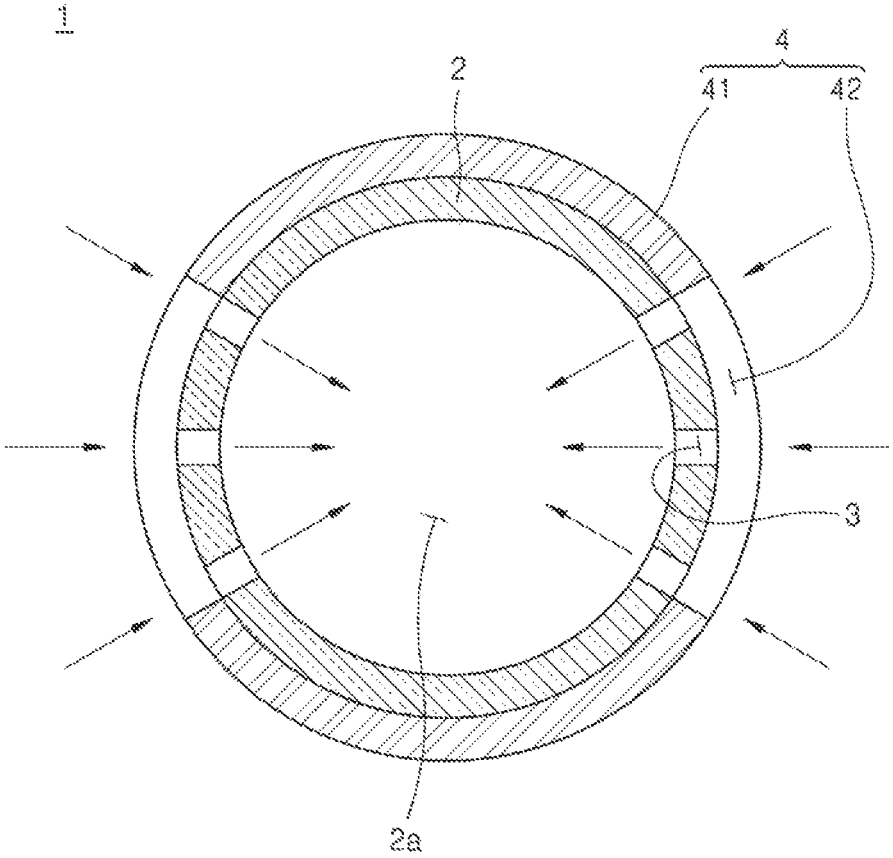
FIG. 9 is a schematic cross-sectional side view of a cooling assembly for an aerosol-generating article taken along line I-I of FIG. 7.
Figure 10:
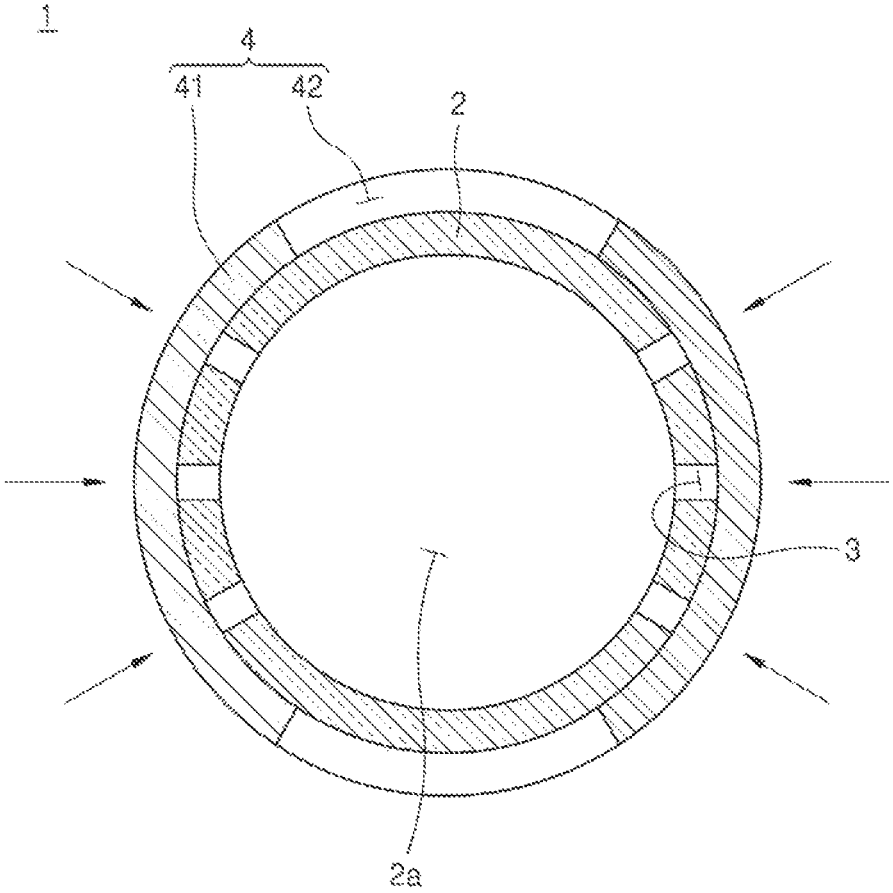
FIG. 10 is a schematic cross-sectional side view of a cooling assembly for an aerosol-generating article taken along line II-II of FIG. 8.

FIG. 9 is a schematic cross-sectional side view of a cooling assembly for an aerosol-generating article taken along line I-I of FIG. 7, and FIG. 10 is a schematic cross-sectional side view of a cooling assembly for an aerosol-generating article taken along line II-II of FIG. 8. The arrows shown in FIGS. 9 and 10 schematically show the flow of air.

Referring to FIGS. 2 to 10, the air volume regulator 4 may include a covering member 41 and a through hole 42.

The covering member 41 is for covering at least some of the perforations 3. The covering member 41 may function as a main body of the air volume regulator 4. The covering member 41 may be movably disposed on the cooling rod 2. The covering member 41 may be rotatably disposed on the cooling rod 2 as shown in FIG. 2 or may be movably disposed along the extending direction of the cooling rod 2 as shown in FIG. 3. The covering member 41 may cover the perforations 3 to prevent air from passing through the perforations 3 as shown in FIGS. 6, 8, and 10. When a plurality of perforations 3 are formed in the cooling rod 2, the covering member 41 may regulate the amount of air passing through the perforations 3 by covering some of the plurality of perforations 3.

The through hole 42 is for communicating with the perforation 3. The through hole 42 may be formed in the covering member 41. The through hole 42 may communicate with the perforation 3 so that air passes through the perforation 3 as shown in FIGS. 5, 7, and 9. At least one through hole 42 may be formed in the covering member 41.

Figure 11:
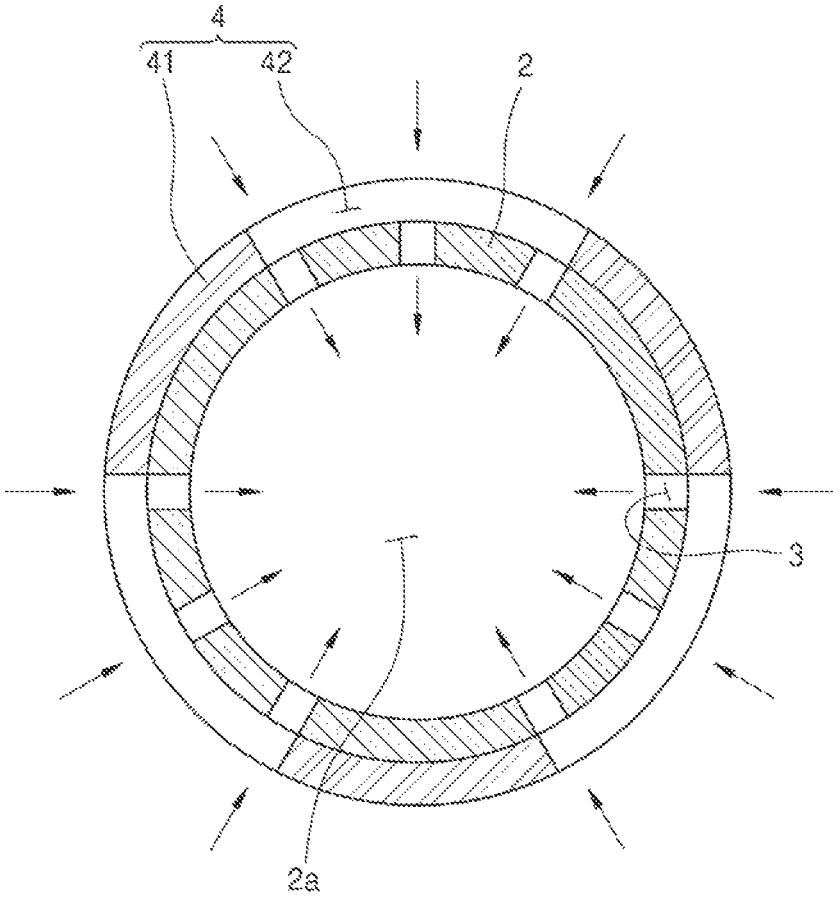
FIG. 11 is a schematic cross-sectional side view of a cooling assembly for an aerosol-generating article taken along line I-I of FIG. 7 to illustrate an embodiment in which perforations are formed in a cooling rod in three groups.

FIG. 11 is a schematic cross-sectional side view of a cooling assembly for an aerosol-generating article taken along line I-I of FIG. 7 to illustrate an embodiment in which perforations are formed in a cooling rod in three groups. The arrows shown in FIG. 11 schematically show the flow of air.

Referring to FIGS. 9 to 11, one or more perforations 3 may be formed in a cooling rod 2 in a group. A plurality of the one group may be formed on the cooling rod 2. For example, the perforations 3 may be formed in two groups as shown in FIGS. 9 and 10, and a plurality of perforations may be formed on the cooling rod 2. The perforations 3 may be formed in three groups as shown in FIG. 11 and a plurality of perforations 3 may be formed in the cooling rod 2. One group may include at least one or more perforations 3.

The through holes 42 may be formed in the covering member 41 in the same number as the number of groups formed by the perforations 3. When the perforations 3 form two groups as shown in FIGS. 9 and 10 and a plurality of holes are formed in the cooling rod 2, two through holes 42 may be formed in the covering member 41. In this case, the separation distance between the two through-holes 42 may be the same as the separation distance between the two groups of the perforations 3. When the perforations 3 form three groups as shown in FIG. 11 and a plurality of holes are formed in the cooling rod 2, three through holes 42 may be formed in the covering member 41. In this case, the separation distance between the three through-holes 42 may be the same as the separation distance between the three groups of the perforations 3.

Figure 12:
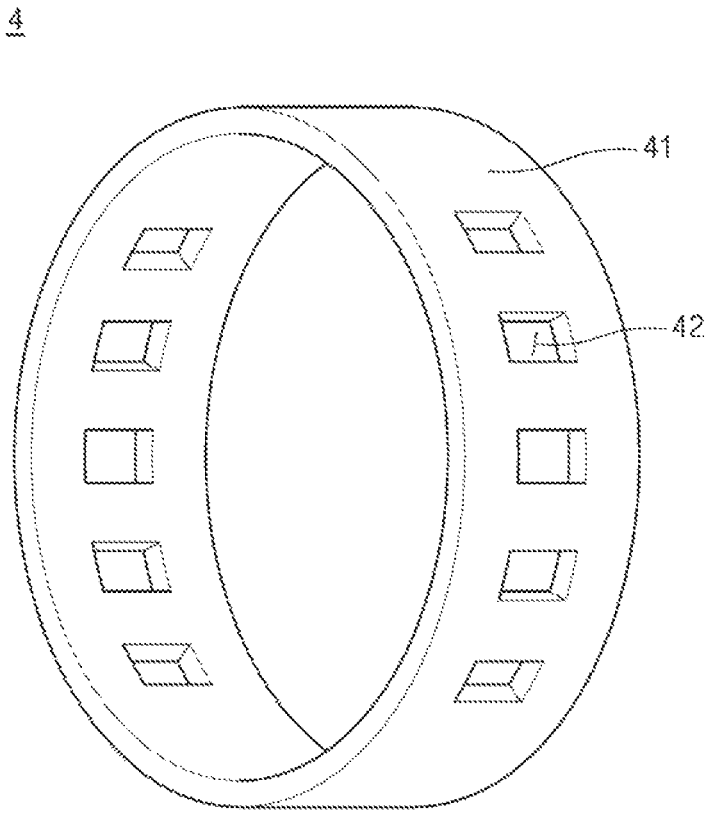
FIG. 12 is a schematic perspective view of an air volume regulator according to another embodiment.
Figure 13:
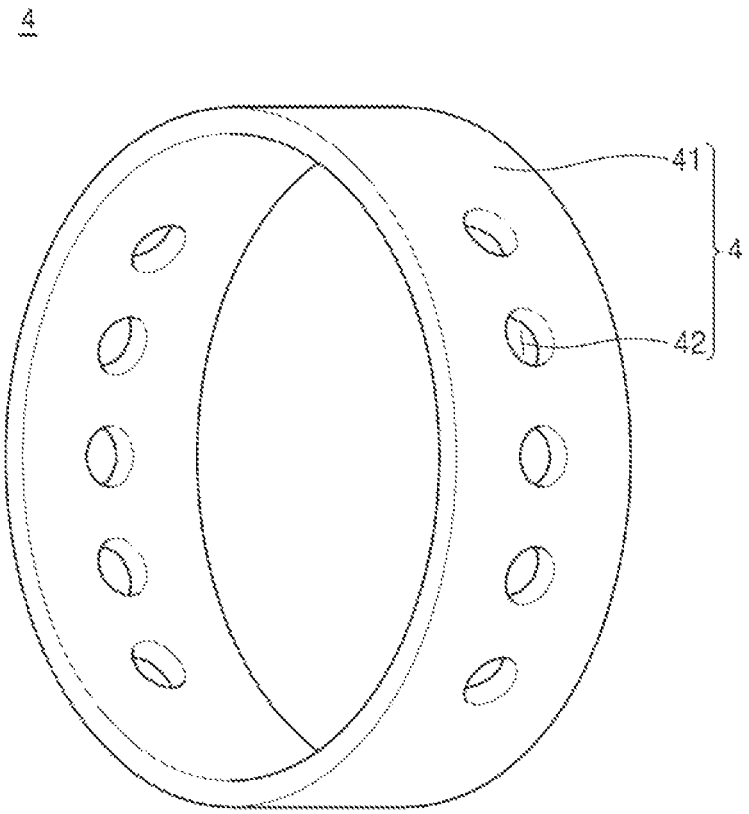
FIG. 13 is a schematic perspective view of an air volume regulator according to another embodiment.

FIG. 12 is a schematic perspective view of an air volume regulator according to another embodiment, and FIG. 13 is a schematic perspective view of an air volume regulator according to another embodiment.

Referring to FIG. 12, a plurality of through holes 42 may be spaced apart from each other to be formed in a covering member 41. In this case, the distance at which the plurality of through holes 42 are spaced apart from each other may be the same as the distance at which a plurality of perforations 3 are spaced apart from each other. The plurality of through holes 42 may be formed to have the same shape as each other.

Referring to FIG. 13, the through hole 42 may be formed to have a shape corresponding to the perforation 3. Accordingly, because the cooling assembly 1 for an aerosol-generating article according to an embodiment may form the through hole 42 in the process of forming the perforation 3, it is possible to reduce the manufacturing cost by reducing the overall number of processes.

Figure 14:
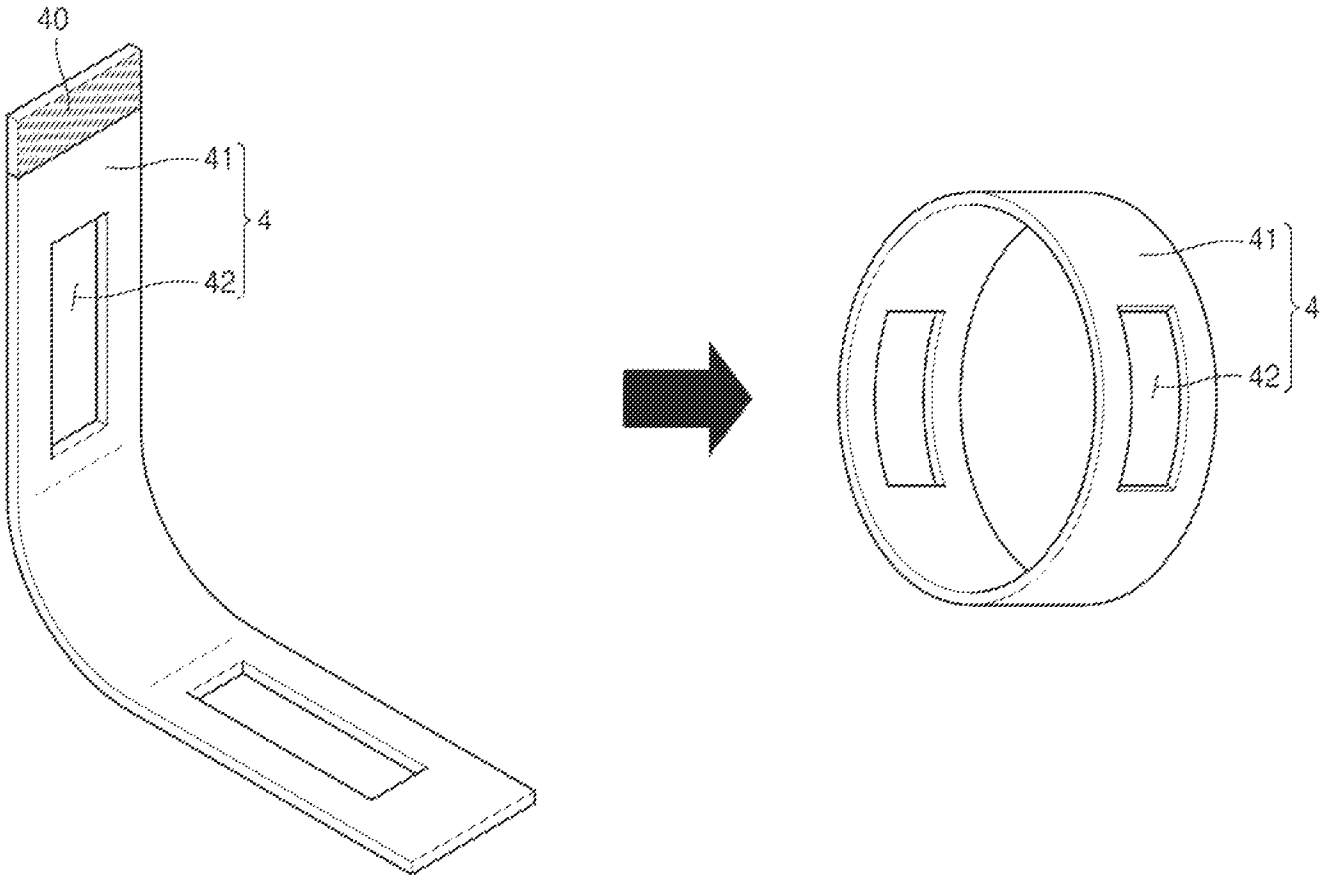
FIG. 14 is a view for explaining a process in which the air volume regulator according to an embodiment is disposed on the outside of a cooling rod.

FIG. 14 is a view for explaining a process in which the air volume regulator according to an embodiment is disposed on the outside of a cooling rod.

Referring to FIG. 14, an air volume regulator 4 may be wound and disposed on the outside of a cooling rod 2. In this case, the air volume regulator 4 may include an adhesive portion 40. The adhesive portion 40 may be disposed on one end of the covering member 41 and serve to bond one end and the other end of the covering member 41. The adhesive portion 40 may include a material having an adhesive force. For example, the adhesive portion 40 may be a double-sided tape.

Figure 15:
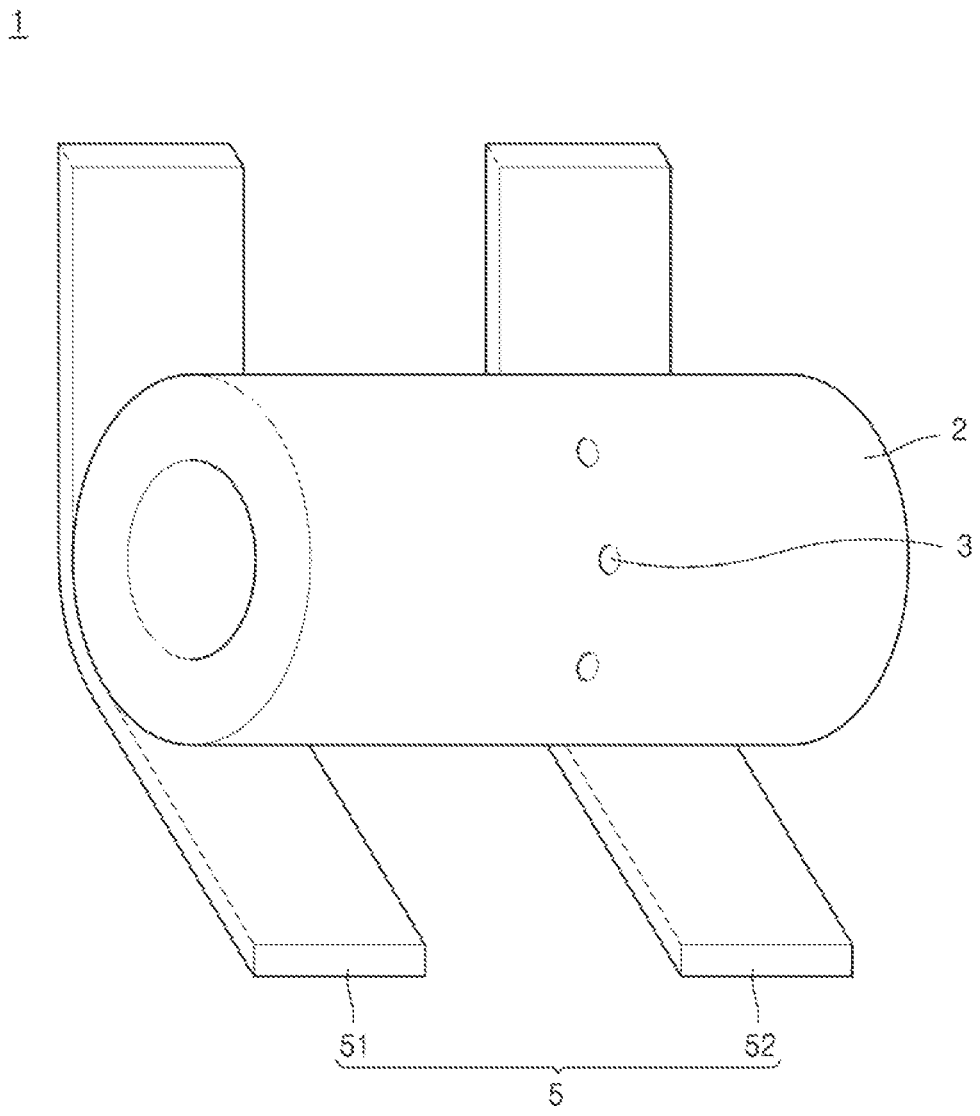
FIGS. 15 and 16 are views for explaining a support device in a cooling assembly for an aerosol-generating article according to an embodiment.
Figure 16:
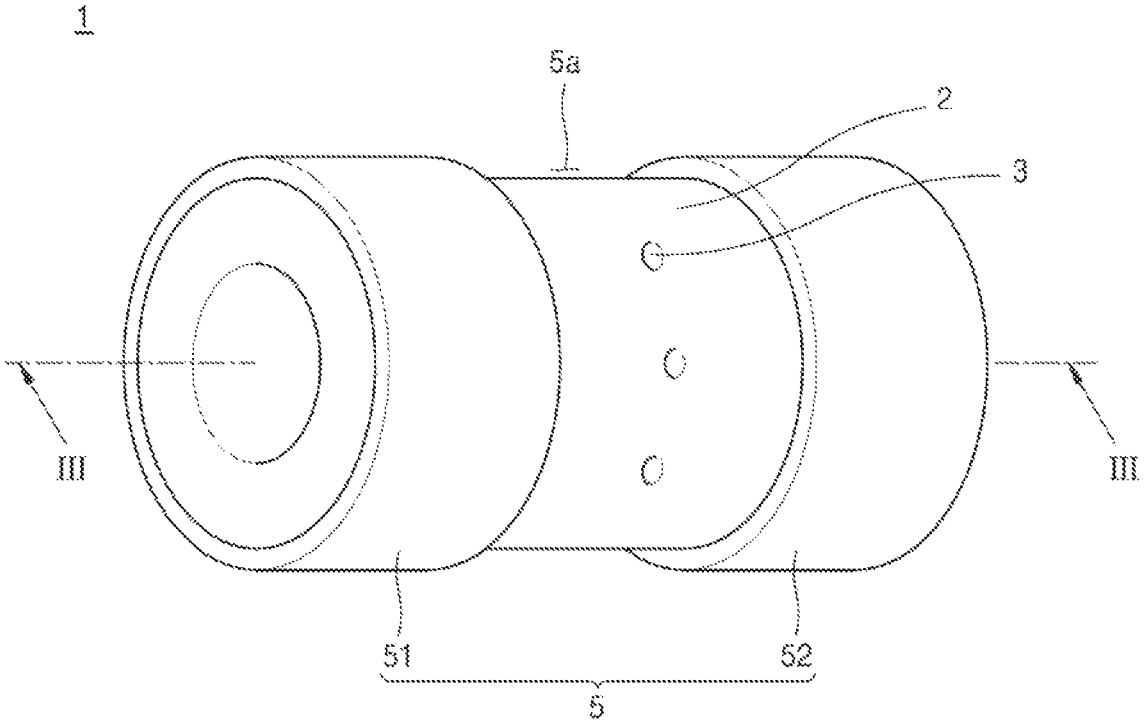
Figure 17:
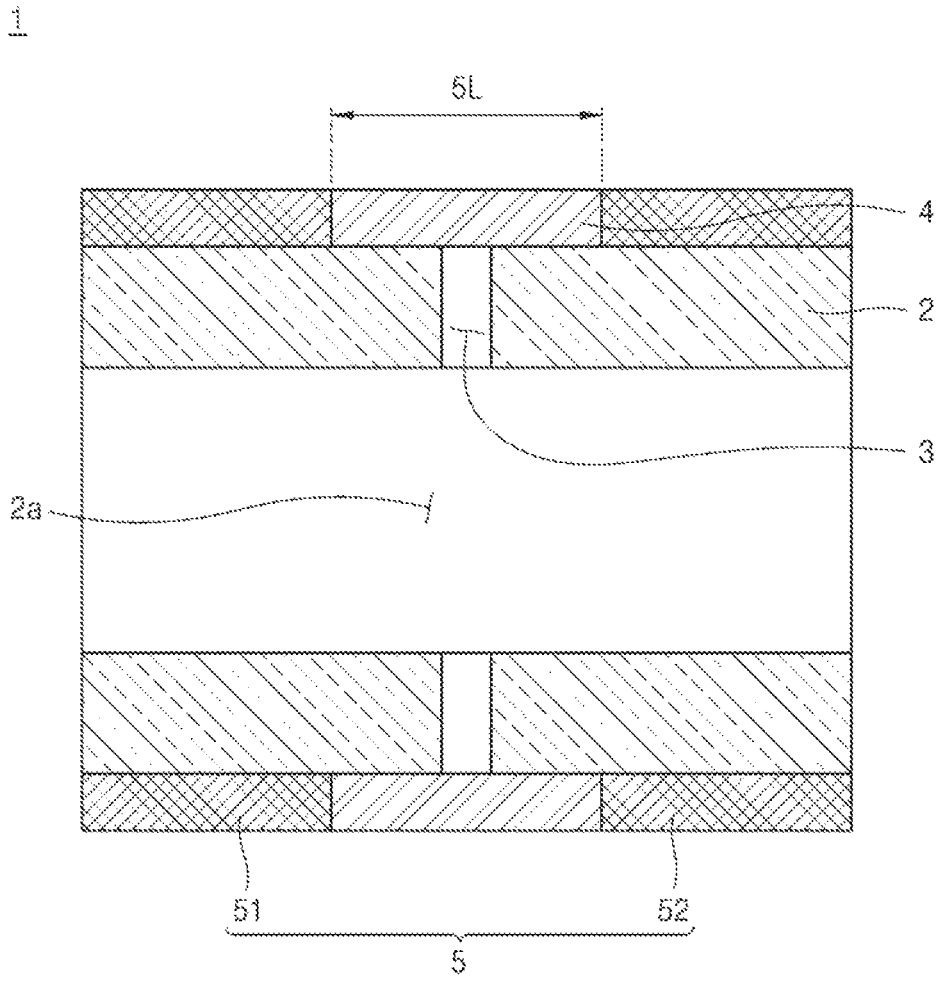
FIG. 17 is a schematic front sectional view of a cooling assembly for an aerosol-generating article taken along line III-III of FIG. 16.

FIGS. 15 and 16 are views for explaining a support device in a cooling assembly for an aerosol-generating article according to an embodiment, and FIG. 17 is a schematic front sectional view of a cooling assembly for an aerosol-generating article taken along line III-III of FIG. 16.

Referring to FIGS. 15 to 17, a cooling assembly 1 for an aerosol-generating article according to an embodiment may further include a support device 5.

The support device 5 is for supporting the air volume regulator 4. Accordingly, the cooling assembly 1 for an aerosol-generating article according to an embodiment may limit the movable distance of the air volume regulator 4, thereby improving the ease of the operation of regulating the amount of air passing through the perforation 3. The support device 5 may protrude to the outside of the cooling rod 2. The support device 5 may be wound and disposed on the outside of the cooling rod 2 as shown in FIGS. 15 and 16. The support device 5 may be formed of a material such as paper, plastic, or vinyl.

The support device 5 may include a first support member 51 and a second support member 52.

The first support member 51 is disposed on one side of the cooling rod 2. One side of the cooling rod 2 may be a part of the cooling rod 2 facing the medium rod 10 from the filter rod 20. The first support member 51 may be disposed on one side of the cooling rod 2 to support one side of the air volume regulator 4. Accordingly, the cooling assembly 1 for an aerosol-generating article according to an embodiment may limit the movement of the air volume regulator 4 to one side.

The second support member 52 is disposed at a position spaced apart from the first support member 51. The second support member 52 may be disposed on the other side of the cooling rod 2. The other side of the cooling rod 2 may be a part of the cooling rod 2 facing the filter rod 20 from the medium rod 10. The second support member 52 may be disposed on the other side of the cooling rod 2 to support the other side of the air volume regulator 4. Accordingly, the cooling assembly 1 for an aerosol-generating article according to an embodiment may limit the movement of the air volume regulator 4 to the other side.

An air volume regulator 4 may be disposed between the second support member 52 and the first support member 51. Accordingly, the support device 5 supports one side and the other side of the air volume regulator 4, thereby limiting the distance the air volume regulator 4 may move in both directions. The air volume regulator 4 may be inserted into the insertion groove 5*a* (shown in FIG. 16) formed between the second support member 52 and the first support member 51.

The separation distance 5L (shown in FIG. 17) between the second support member 52 and the first support member 51 may be formed to be the same as the length of the air volume regulator 4 based on the extending direction of the cooling rod 2. Accordingly, because the support device 5 may further restrict the movable distance of the air volume regulator 4, the supporting force for supporting the air volume regulator 4 may be improved.

Figure 18:
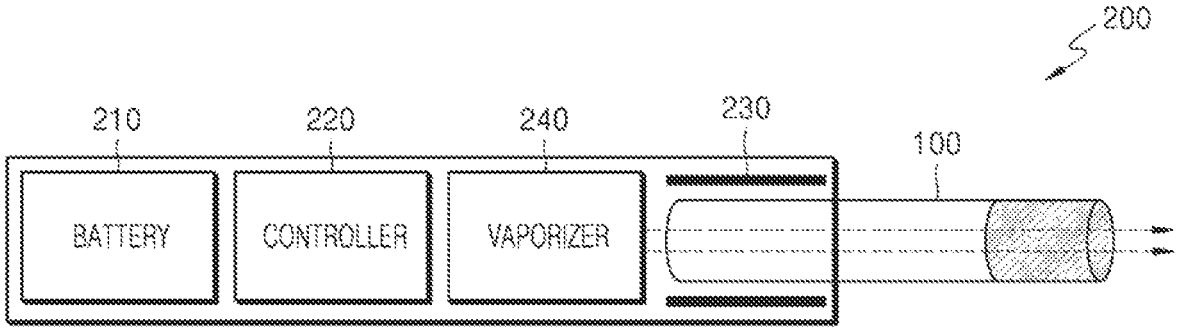
FIGS. 18 and 19 are schematic views illustrating an example in which an aerosol-generating article is inserted into an aerosol-generating device.
Figure 19:
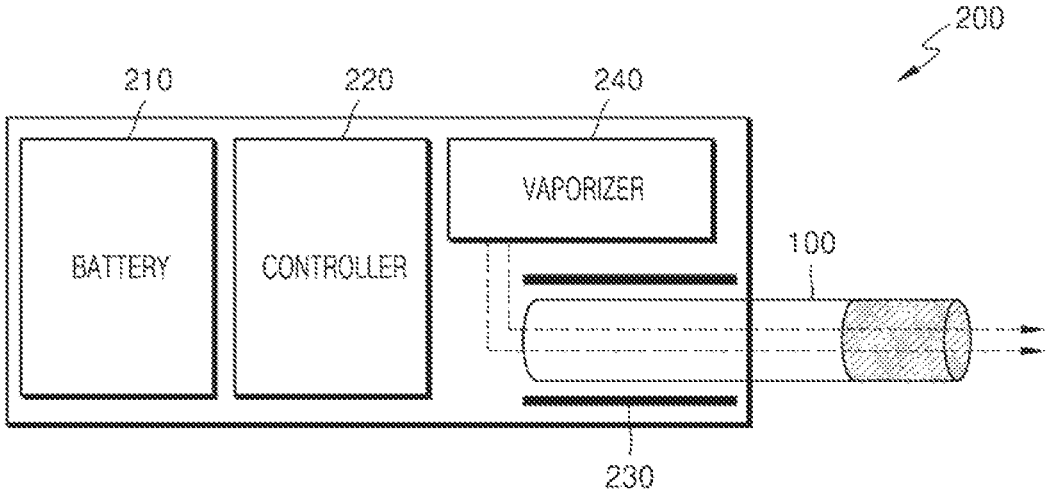

FIGS. 18 and 19 are schematic views illustrating an example in which an aerosol-generating article is inserted into an aerosol-generating device.

Referring to FIGS. 18 and 19, an aerosol-generating device 200 includes a battery 210, a controller 220, a heater 230, and a vaporizer 240. In addition, the aerosol-generating article 100 may be inserted into the inner space of the aerosol-generating device 200.

FIGS. 18 and 19 illustrate components of the aerosol generating device 200, which are related to the present embodiment. Therefore, it will be understood by one of ordinary skill in the art related to the present embodiment that other general-purpose components may be further included in the aerosol generating device 200, in addition to the components illustrated in FIGS. 18 and 19.

Also, FIGS. 18 and 10 illustrate that the aerosol generating device 200 includes the heater 230. However, according to necessity, the heater 230 may be omitted.

FIG. 18 illustrates that the battery 210, the controller 220, the vaporizer 240, and the heater 230 are arranged in series. Also, FIG. 19 illustrates that the vaporizer 240 and the heater 230 are arranged in parallel. However, the internal structure of the aerosol generating device 200 is not limited to the structures illustrated in FIGS. 18 and 19. In other words, according to the design of the aerosol generating device 200, the battery 210, the controller 220, the heater 230, and the vaporizer 240 may be differently arranged.

When the aerosol-generating article 100 is inserted into the aerosol generating device 200, the aerosol generating device 200 may operate the heater 230 and/or the vaporizer 240 to generate an aerosol from the aerosol-generating article 100 and/or the vaporizer 14. The aerosol generated by the heater 230 and/or the vaporizer 240 is delivered to a user by passing through the aerosol-generating article 100.

According to necessity, even when the aerosol-generating article 100 is not inserted into the aerosol generating device 200, the aerosol generating device 200 may heat the heater 230.

The battery 210 may supply power to be used for the aerosol generating device 200 to operate. For example, the battery 210 may supply power to heat the heater 230 or the vaporizer 240, and may supply power for operating the controller 220. Also, the battery 210 may supply power for operations of a display, a sensor, a motor, etc. mounted in the aerosol generating device 200.

The controller 220 may generally control operations of the aerosol generating device 200. In detail, the controller 220 may control not only operations of the battery 210, the heater 230, and the vaporizer 240, but also operations of other components included in the aerosol generating device 200. Also, the controller 220 may check a state of each of the components of the aerosol generating device 200 to determine whether or not the aerosol generating device 200 is able to operate.

The controller 220 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 230 may be heated by the power supplied from the battery 210. For example, when a cigarette is inserted into the aerosol generating device 200, the heater 230 may be located outside the cigarette. Thus, the heated heater 230 may increase a temperature of an aerosol generating material in the cigarette.

The heater 230 may include an electro-resistive heater. For example, the heater 230 may include an electrically conductive track, and the heater 230 may be heated when currents flow through the electrically conductive track. However, the heater 230 is not limited to the example described above and may include all heaters which may be heated to a desired temperature. Here, the desired temperature may be pre-set in the aerosol generating device 200 or may be set as a temperature desired by a user.

As another example, the heater 230 may include an induction heater. In detail, the heater 230 may include an electrically conductive coil for heating a cigarette in an induction heating method, and the cigarette may include a susceptor which may be heated by the induction heater.

For example, the heater 230 may include a tube-type heating element, a plate-type heating element, a needle-type heating element, or a rod-type heating element, and may heat the inside or the outside of the aerosol-generating article 100, according to the shape of the heating element.

Also, the aerosol generating device 200 may include a plurality of heaters 230. Here, the plurality of heaters 230 may be inserted into the aerosol-generating article 100 or may be arranged outside the aerosol-generating article 100. Also, some of the plurality of heaters 230 may be inserted into the aerosol-generating article 100 and the others may be arranged outside the aerosol-generating article 100. In addition, the shape of the heater 230 is not limited to the shapes illustrated in FIGS. 18 and 19 and may include various shapes.

The vaporizer 240 may generate an aerosol by heating a liquid composition and the generated aerosol may pass through the aerosol-generating article 100 to be delivered to a user. In other words, the aerosol generated via the vaporizer 240 may move along an air flow passage of the aerosol generating device 200 and the air flow passage may be configured such that the aerosol generated via the vaporizer 240 passes through the cigarette to be delivered to the user.

For example, the vaporizer 240 may include a liquid storage, a liquid delivery element, and a heating element, but it is not limited thereto. For example, the liquid storage, the liquid delivery element, and the heating element may be included in the aerosol generating device 200 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 240 or may be formed integrally with the vaporizer 240.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. The vitamin mixture may be a mixture of at least one of vitamin A, vitamin B, vitamin C, and vitamin E, but are not limited thereto. Also, the liquid composition may include an aerosol former such as glycerin or propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 240 may be referred to as a cartomizer or an atomizer, but it is not limited thereto.

The aerosol generating device 200 may further include general-purpose components in addition to the battery 210, the controller 220, the heater 230, and the vaporizer 240. For example, the aerosol generating device 200 may include a display capable of outputting visual information and/or a motor for outputting haptic information. Also, the aerosol generating device 200 may include at least one sensor (a puff detecting sensor, a temperature detecting sensor, a cigarette insertion detecting sensor, etc.). Also, the aerosol generating device 200 may be formed as a structure where, even when the aerosol-generating article 100 is inserted into the aerosol generating device 200, external air may be introduced or internal air may be discharged.

Although not illustrated in FIGS. 18 and 19, the aerosol generating device 200 and an additional cradle may form together a system. For example, the cradle may be used to charge the battery 210 of the aerosol generating device 200. Alternatively, the heater 230 may be heated when the cradle and the aerosol generating device 200 are coupled to each other.

The entire first portion may be inserted into the aerosol generating device 200, and the second portion may be exposed to the outside. Alternatively, only a portion of the first portion may be inserted into the aerosol generating device 200, or the entire first portion and a portion of the second portion may be inserted into the aerosol generating device 200. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 200. For example, the opening and closing and/or a size of the air passage formed in the aerosol generating device 200 may be adjusted by the user. Accordingly, the amount of smoke and a smoking impression may be adjusted by the user. As another example, the external air may flow into the aerosol-generating article 100 through at least one hole formed in a surface of the aerosol-generating article 100.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is illustrated in the claims rather than the foregoing description, and all differences within the equivalent scope should be interpreted as being included in the present disclosure.

The invention claimed is:

1. A cooling assembly for aerosol-generating articles, the cooling assembly comprising:

a cooling rod with a tube-shaped structure including a hollow for cooling an aerosol generated by the aerosol-generating article;

a plurality of perforations formed through the cooling rod in a radial direction such that air passes through the plurality of perforations and is introduced into the hollow; and an air volume regulator disposed on the outside of the cooling rod to cover at least some of the plurality of the perforations, and configured to regulate an amount of air passing through the plurality of perforations as the air volume regulator moves from one position to another, wherein the plurality of perforations are arranged along a circumferential direction of the cooling rod, wherein the air volume regulator is configured to rotate along the circumferential direction of the cooling rod to regulate the amount of air passing through the plurality of perforations, wherein the air volume regulator includes a covering member for covering the at least some of the plurality of perforations, and a plurality of through holes formed in the covering member and communicating with the plurality of perforations, wherein the plurality of perforations form a plurality of groups of perforations, and the plurality of groups of perforations are spaced apart with an equal distance along the circumferential direction of the cooling rod, wherein a separation distance between the plurality of through holes is equal to the equal distance between the plurality of groups perforations, and wherein each of the plurality of through holes has a shape corresponding to a shape of the plurality of perforations of each of the plurality of groups of perforations.

2. The cooling assembly of claim 1, wherein the air volume regulator is disposed to surround the cooling rod.

3. The cooling assembly of claim 1, further includes a support device protruding to the outside of the cooling rod and for supporting the air volume regulator.

4. The cooling assembly of claim 3, wherein the support device includes a first support member disposed on one side of the cooling rod to support one side of the air volume regulator, and a second support member disposed on the other side of the cooling rod to support the other side of the air volume regulator.

5. The cooling assembly of claim 4, wherein the air volume regulator is disposed between the first support member and the second support member.

6. The cooling assembly of claim 5, wherein a separation distance between the second support member and the first support member is the same as a length of the air volume regulator with respect to an extending direction of the cooling rod.

7. An aerosol-generating article comprising:

a cooling assembly for an aerosol-generating article according to claim 1;

a medium rod disposed on one side of the cooling assembly for the aerosol-generating article; and a filter rod disposed on the other side of the cooling assembly for the aerosol-generating article.

* * * * *